US011153707B1

(12) United States Patent
Zellner et al.

(10) Patent No.: US 11,153,707 B1
(45) Date of Patent: Oct. 19, 2021

(54) FACILITATION OF AUDIO FOR AUGMENTED REALITY

(71) Applicant: AT&T Intellectual Property I, L.P., Atlanta, GA (US)

(72) Inventors: Brittaney Zellner, Smyrna, GA (US); Sameena Khan, Peachtree Corners, GA (US); Ryan Schaub, Berkeley Lake, GA (US); Barrett Kreiner, Woodstock, GA (US); Ari Craine, Marietta, GA (US); Robert Koch, Peachtree Corners, GA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 0 days.

(21) Appl. No.: 16/851,514

(22) Filed: Apr. 17, 2020

(51) Int. Cl.
*H04S 7/00* (2006.01)

(52) U.S. Cl.
CPC ..... *H04S 7/304* (2013.01)

(58) Field of Classification Search
None
See application file for complete search history.

(56) References Cited

U.S. PATENT DOCUMENTS

| | | | | |
|---|---|---|---|---|
| 8,874,592 | B2 | 10/2014 | Flake et al. | |
| 9,916,693 | B1 | 3/2018 | Carr et al. | |
| 9,928,657 | B2 * | 3/2018 | De Pasquale | G06T 19/006 |
| 10,891,792 | B1 | 1/2021 | Bhushan et al. | |
| 2002/0199156 | A1 | 12/2002 | Chess et al. | |
| 2008/0310707 | A1 | 12/2008 | Kansal et al. | |
| 2012/0320033 | A1 | 12/2012 | Papaefstathiou et al. | |
| 2017/0103440 | A1 | 4/2017 | Xing et al. | |
| 2018/0159838 | A1 * | 6/2018 | Dintenfass | H04L 63/0861 |
| 2018/0173323 | A1 | 6/2018 | Harvey et al. | |
| 2018/0239144 | A1 | 8/2018 | Woods et al. | |
| 2018/0309806 | A1 * | 10/2018 | Huynh | G06F 3/04886 |
| 2019/0302460 | A1 | 10/2019 | Kaul et al. | |
| 2019/0341050 | A1 * | 11/2019 | Diamant | G06K 9/00288 |

OTHER PUBLICATIONS

Zhang et al, "Time-Series Prediction of Environmental Noise for Urban IoT Based on Long Short-Term Memory Recurrent Neural Network." pp. 1-18. (Year: 2020).*

Stipetic, et al. "7 Best Real Estate and Architecture Augmented Reality Apps."https://www.supersuperagency.com/blog/7-best-real-estate-architecture-augmented-reality-apps. Last Accessed Mar. 31, 2020. 10 pages.

(Continued)

*Primary Examiner* — Qin Zhu
(74) *Attorney, Agent, or Firm* — Amin, Turocy & Watson, LLP

(57) ABSTRACT

A view can be presented with an augmented reality (AR) view of the space. The viewer can also initiate alterations to the environment based on the information and recommendations presented in the AR view. Current conditions, past trends, and forecasted future trends can be included in the creation of the AR displays. For example, the AR system can capture, archive, and predict audio to accompany an augmented reality or virtual reality experience. The audio presented with the experience can be from a real-time capture, an audio file captured in the past, and/or a simulated audio file representing an estimated past or future environment.

20 Claims, 10 Drawing Sheets

(56) References Cited

OTHER PUBLICATIONS

Goldsmith, et al. "Augmented Reality Environmental Monitoring Using Wireless Sensor Networks." Proceedings of the 2008 12th International Conference on Information Visualisation (IV08), 2008. 7 pages.
Fukuda, et al. "An indoor thermal environment design system for renovation using augmented reality." Journal of Computational Design and Engineering 6 (2019) 179-188. 10 pages.
Natephra, et al. "Live data visualization of IoT sensors using Augmented Reality (AR) and BIM." 36th International Symposium on Automation and Robotics in Construction (ISARC 2019). 8 pages.
Office Action dated Apr. 1, 2021 for U.S. Appl. No. 16/850,632, 42 pages.

* cited by examiner

FACILITATION OF AUDIO FOR AUGMENTED REALITY

TECHNICAL FIELD

This disclosure relates generally to facilitating augmented reality assessments and processes. For example, this disclosure relates to facilitating audio for augmented reality sessions.

BACKGROUND

Augmented reality (AR) is an interactive experience of a real-world environment where the objects that reside in the real world are enhanced by computer-generated perceptual information, sometimes across multiple sensory modalities, including visual, auditory, haptic, somatosensory and olfactory. An augogram is a computer-generated image that is used to create AR. Augography is the science and practice of making augograms for AR. AR can be defined as a system that fulfills three basic features: a combination of real and virtual worlds, real-time interaction, and accurate 3D registration of virtual and real objects. The overlaid sensory information can be constructive (e.g., additive to the natural environment), or destructive (e.g., masking of the natural environment). This experience is seamlessly interwoven with the physical world such that it is perceived as an immersive aspect of the real environment. In this way, augmented reality alters one's ongoing perception of a real-world environment, whereas virtual reality completely replaces the user's real-world environment with a simulated one. Augmented reality is related to two largely synonymous terms: mixed reality and computer-mediated reality.

The above-described background relating to audio for augmented reality space assessment is merely intended to provide a contextual overview of some current issues, and is not intended to be exhaustive. Other contextual information may become further apparent upon review of the following detailed description.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
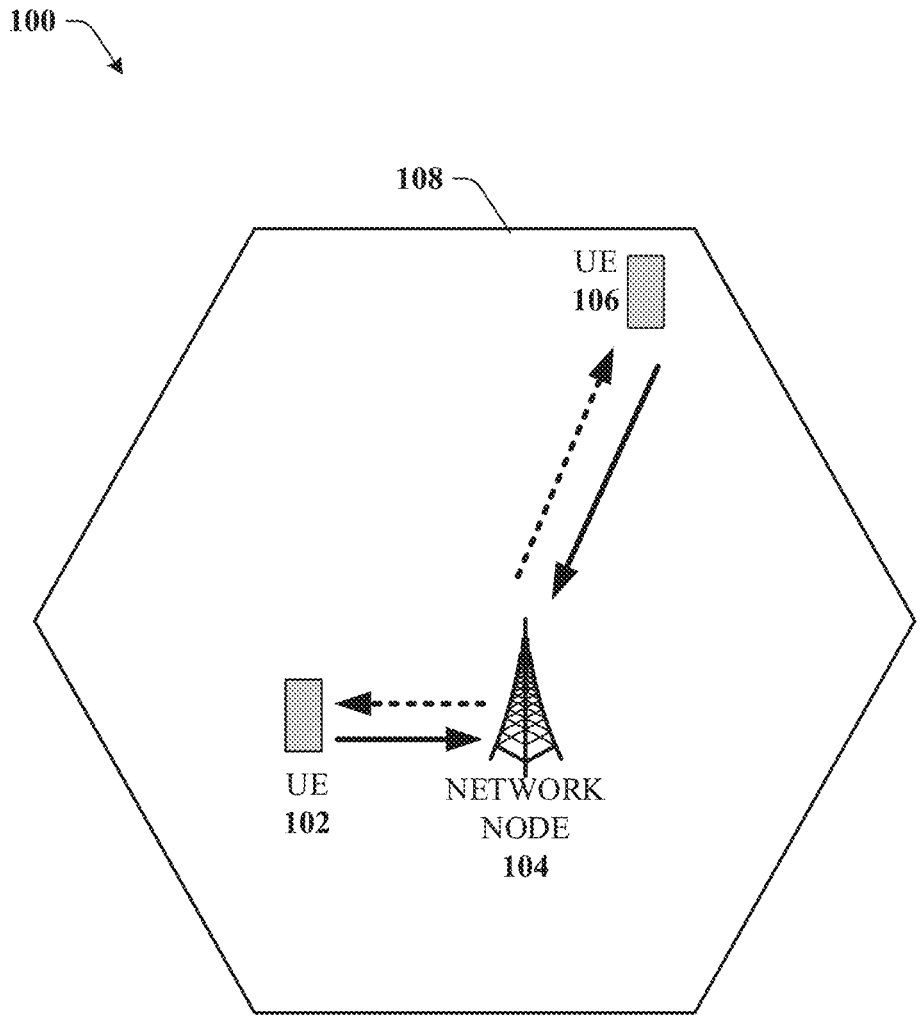
FIG. 1 illustrates an example wireless communication system in which a network node device (e.g., network node) and user equipment (UE) can implement various aspects and embodiments of the subject disclosure.

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

As utilized herein, terms "component," "system," "interface," and the like are intended to refer to a computer-related entity, hardware, software (e.g., in execution), and/or firmware. For example, a component can be a processor, a process running on a processor, an object, an executable, a program, a storage device, and/or a computer. By way of illustration, an application running on a server and the server can be a component. One or more components can reside within a process, and a component can be localized on one computer and/or distributed between two or more computers.

Further, these components can execute from various machine-readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

As used herein, the term "infer" or "inference" refers generally to the process of reasoning about, or inferring states of, the system, environment, user, and/or intent from a set of observations as captured via events and/or data. Captured data and events can include user data, device data, environment data, data from sensors, sensor data, application data, implicit data, explicit data, etc. Inference can be employed to identify a specific context or action, or can generate a probability distribution over states of interest based on a consideration of data and events, for example.

Inference can also refer to techniques employed for composing higher-level events from a set of events and/or data. Such inference results in the construction of new events or actions from a set of observed events and/or stored event data, whether the events are correlated in close temporal proximity, and whether the events and data come from one or several event and data sources. Various classification schemes and/or systems (e.g., support vector machines, neural networks, expert systems, Bayesian belief networks, fuzzy logic, and data fusion engines) can be employed in connection with performing automatic and/or inferred action in connection with the disclosed subject matter.

In addition, the disclosed subject matter can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, machine-readable device, computer-readable carrier, computer-readable media, or machine-readable media. For example, computer-readable media can include, but are not limited to, a magnetic storage device, e.g., hard disk; floppy disk; magnetic strip(s); an optical disk (e.g., compact disk (CD), a digital video disc (DVD), a Blu-ray Disc™ (BD)); a smart card; a flash memory device (e.g., card, stick, key drive); and/or a virtual device that emulates a storage device and/or any of the above computer-readable media.

As an overview, various embodiments are described herein to facilitate audio for augmented reality sessions. For simplicity of explanation, the methods (or algorithms) are depicted and described as a series of acts. It is to be understood and appreciated that the various embodiments are not limited by the acts illustrated and/or by the order of acts. For example, acts can occur in various orders and/or concurrently, and with other acts not presented or described herein. Furthermore, not all illustrated acts may be required to implement the methods. In addition, the methods could alternatively be represented as a series of interrelated states via a state diagram or events. Additionally, the methods described hereafter are capable of being stored on an article of manufacture (e.g., a machine-readable storage medium) to facilitate transporting and transferring such methodologies to computers. The term article of manufacture, as used herein, is intended to encompass a computer program accessible from any computer-readable device, carrier, or media, including a non-transitory machine-readable storage medium.

It should be noted that although various aspects and embodiments have been described herein in the context of 5G, Universal Mobile Telecommunications System (UMTS), and/or Long Term Evolution (LTE), or other next generation networks, the disclosed aspects are not limited to 5G, a UMTS implementation, and/or an LTE implementation as the techniques can also be applied in 3G, 4G or LTE systems. For example, aspects or features of the disclosed embodiments can be exploited in substantially any wireless communication technology. Such wireless communication technologies can include UMTS, Code Division Multiple Access (CDMA), Wi-Fi, Worldwide Interoperability for Microwave Access (WiMAX), General Packet Radio Service (GPRS), Enhanced GPRS, Third Generation Partnership Project (3GPP), LTE, Third Generation Partnership Project 2 (3GPP2) Ultra Mobile Broadband (UMB), High Speed Packet Access (HSPA), Evolved High Speed Packet Access (HSPA+), High-Speed Downlink Packet Access (HSDPA), High-Speed Uplink Packet Access (HSUPA), Zigbee, or another IEEE 802.12 technology. Additionally, substantially all aspects disclosed herein can be exploited in legacy telecommunication technologies.

Described herein are systems, methods, articles of manufacture, and other embodiments or implementations that can facilitate audio for augmented reality sessions. Facilitating augmented reality audio can be implemented in connection with any type of device with a connection to the communications network (e.g., a mobile handset, a computer, a handheld device, etc.) any Internet of things (TOT) device (e.g., toaster, coffee maker, blinds, music players, speakers, etc.), and/or any connected vehicles (cars, airplanes, space rockets, and/or other at least partially automated vehicles (e.g., drones)). In some embodiments the non-limiting term user equipment (UE) is used. It can refer to any type of wireless device that communicates with a radio network node in a cellular or mobile communication system. Examples of UE are target device, device to device (D2D) UE, machine type UE or UE capable of machine to machine (M2M) communication, PDA, Tablet, mobile terminals, smart phone, laptop embedded equipped (LEE), laptop mounted equipment (LME), USB dongles etc. Note that the terms element, elements and antenna ports can be interchangeably used but carry the same meaning in this disclosure. The embodiments are applicable to single carrier as well as to multicarrier (MC) or carrier aggregation (CA) operation of the UE. The term carrier aggregation (CA) is also called (e.g. interchangeably called) "multi-carrier system", "multi-cell operation", "multi-carrier operation", "multi-carrier" transmission and/or reception.

In some embodiments the non-limiting term radio network node or simply network node is used. It can refer to any type of network node that serves UE is connected to other network nodes or network elements or any radio node from where UE receives a signal. Examples of radio network nodes are Node B, base station (BS), multi-standard radio (MSR) node such as MSR BS, eNode B, network controller, radio network controller (RNC), base station controller (BSC), relay, donor node controlling relay, base transceiver station (BTS), access point (AP), transmission points, transmission nodes, RRU, RRH, nodes in distributed antenna system (DAS) etc.

Cloud radio access networks (RAN) can enable the implementation of concepts such as software-defined network (SDN) and network function virtualization (NFV) in 5G networks. Certain embodiments of this disclosure can comprise an SDN controller that can control routing of traffic within the network and between the network and traffic destinations. The SDN controller can be merged with the 5G network architecture to enable service deliveries via open application programming interfaces ("APIs") and move the network core towards an all internet protocol ("IP"), cloud based, and software driven telecommunications network. The SDN controller can work with, or take the place of policy and charging rules function ("PCRF") network elements so that policies such as quality of service and traffic management and routing can be synchronized and managed end to end.

This disclosure describes a solution to capture, archive, and predict audio to accompany an augmented reality or virtual reality experience. The audio presented with the experience can be from a real-time capture, an audio file captured in the past, and/or a simulated audio file representing an estimated past or future environment.

A microphone can be positioned to capture ambient audio at a location. This can be a fixed or mobile microphone and it can optionally be a part of a camera for still or video capture. The microphone can be a part of a device such as a smartphone, smartwatch, or other networked personal device. It should be noted that the microphone can be a digital or a non-digital microphone. For example, if the microphone is digital, it can produce audio data, however, the microphone can be non-digital and produce an audio signal that can be digitized by an analog-to-digital converter to produce the outputs for facilitation of the scenarios outlined in this disclosure. The camera can also be a part of a mobile camera that traverses interiors or exteriors in order to capture video to be used for navigation purposes. The microphone can have a unique network identification (ID) such as an internet protocol (IP) address and it can be location aware so that it can identify its location (e.g., via latitude and/or longitude coordinates) at a point in time. Moreover, a plurality of such microphones can be used to capture audio segments in an aggregate manner. This can be dozens, hundreds, or millions of such microphones all contributing to a collective audio library.

As an example, a microphone can be used to capture a segment of audio in a residential neighborhood. The segment of audio can be for a period of time, T, and the location can be recorded to be at a latitude/longitude location, X,Y. The audio content, timestamps for the beginning and end of the audio, and/or the location can be sent to an audio server. The audio server can receive numerous such audio files with associated metadata from numerous sources. Other metadata can also be stored, such as a source ID to identify a person or entity that provided the audio file. This can be used, for instance, to provide a reward or other token of value to the provider for contributing the content. If the microphone was in motion during the audio capture, the audio server can calculate an average location, $X_{avg}$, $Y_{avg}$.

An exemplary embodiment, this collected audio can be for use in the case of searching for real estate properties. There can be many other similar use cases, however, the real estate example is used here for demonstration. An internet user can log into a web server to view a location. This can be a static image of a street location, or it can be an interactive street view in which the user can interact with the image to simulate moving around the neighborhood, thereby changing the view presented. The viewer can be searching the neighborhood and want to hear what the ambient noise is typically like. The audio server can be queried with a location ID and be asked to return the most recent audio recording created nearest to the location. The audio server can return the audio for presentation to the user, including data that can be used to present information about the audio that is playing. The audio can thus be from a separate source than the visual display. This solution also enables the presentation of live audio to the same internet user. In this case, an audio source can identify itself as live streaming, and the audio content in the audio archive can be tagged as a live stream. The live streaming audio can be presented to the user, and the user's display can reflect an indication that the audio playing to them is a live stream. Again, this audio can be from a separate source than the visual display.

The internet user can wish to modify the time parameters to simulate what the ambient noise in the area is like in the future or what it was like in the past. The internet user can also modify parameters to request that any notable noise events, perhaps above a certain decibel level, are presented to the user. The system can also be used to create simulated audio that is representative of a point in time when an actual audio recording does not exist. Options can be presented to the user to select a time and date for the simulated audio. The time and date selected by the user can be in the past or in the future. The time and date selected, along with the location, can be sent to the audio server. If it finds an actual recording corresponding to the time and location requested in the audio archive, the audio content can be retrieved and sent to the internet user for presentation.

If no actual audio content is found for the user-selected time, date, and/or location requested, the audio server can create a simulated audio file to be presented to the user. For instance, if the user is conducting the search in the year 2020 and wishes to hear a simulation of the ambient noise in the year 2030, they can make that request. The audio server can use the audio content from the audio archive that is the closest in time and location to the actual request as a baseline. To modify this baseline audio, the audio server can access predictive environmental (PE) data from one or more sources. This PE data can comprise data that represents planned or predicted trends for the area. Examples can include predicted increases in road traffic, predicted % of electric cars, predicted changes in demographics (e.g., more children moving into the area, or families with dogs), planned new construction (e.g., schools, or businesses), and other factors. This data can be collected from databases of planned changes or predicted trends.

To create the simulated audio, the audio server can use the baseline audio and mix in supplemental audio from a library. For instance, if a construction project is planned during the time requested, simulated construction sounds can be added to the baseline audio. If the projected trends indicate a higher number of children, sounds of children laughing and playing can be added, or dogs barking can be retrieved from the library and added. Planned changes to airport flight paths, frequency of delivery trucks in the area, and many other factors can be included.

The audio server can also sample the traffic noise from the baseline audio and increase its volume by 30%, or adjust the baseline audio to include the sound of a car passing by 30% more frequently, for example. The resulting baseline audio, now modified, can be sent by the audio server for presentation to the internet user. An informative display can be presented to the internet user visually to describe the audio that they are hearing. Similarly, the baseline audio file can be adjusted to account for changes in the area. In this case, the environmental data can be historical rather than predictive and can result in a more accurate simulation.

The audio server can create or retrieve audio to send to a user in the same manner if the user is participating in an augmented reality or virtual reality experience. In the case of VR, the video content presented to the user can have a location ID associated with it that represents the real-world location. In the case of AR, the AR viewer can be used to determine the location being viewed and send it with the request for audio to the audio server. In the case of AR, the more practical uses are for time-shifted audio, rather than real-time live audio.

It should also be noted that an artificial intelligence (AI) component can facilitate automating one or more features in accordance with the disclosed aspects. A memory and a processor as well as other components can include functionality with regard to the figures. The disclosed aspects in connection with audio for augmented reality can employ various AI-based schemes for carrying out various aspects thereof. For example, a process for detecting one or more trigger events, generating audio as a result of the one or more trigger events, and modifying one or more reported measurements, and so forth, can be facilitated with an example automatic classifier system and process. In another example, a process for penalizing one augmented reality audio file while preferring another augmented reality-based audio file can be facilitated with the example automatic classifier system and process.

An example classifier can be a function that maps an input attribute vector, x=(x1, x2, x3, x4, xn), to a confidence that the input belongs to a class, that is, f(x)=confidence(class). Such classification can employ a probabilistic and/or statistical-based analysis (e.g., factoring into the analysis utilities and costs) to prognose or infer an action that can be automatically performed.

A support vector machine (SVM) is an example of a classifier that can be employed. The SVM can operate by finding a hypersurface in the space of possible inputs, which the hypersurface attempts to split the triggering criteria from the non-triggering events. Intuitively, this makes the classification correct for testing data that is near, but not identical to training data. Other directed and undirected model classification approaches include, for example, naïve Bayes, Bayesian networks, decision trees, neural networks, fuzzy logic models, and probabilistic classification models providing different patterns of independence can be employed. Classification as used herein also may be inclusive of statistical regression that is utilized to develop models of priority.

The disclosed aspects can employ classifiers that are explicitly trained (e.g., via a generic training data) as well as implicitly trained (e.g., via observing mobile device usage as it relates to triggering events, observing network frequency/technology, receiving extrinsic information, and so on). For example, SVMs can be configured via a learning or training phase within a classifier constructor and feature selection module. Thus, the classifier(s) can be used to automatically learn and perform a number of functions, including but not limited to modifying an audio file to be output, modifying one or more reported audio measurements, and so forth. The criteria can include, but is not limited to, predefined values, frequency attenuation tables or other parameters, service provider preferences and/or policies, and so on.

In one embodiment, described herein is a method comprising receiving real-time audio data representing an audio signal from a microphone, by a server device comprising a processor, wherein the real-time audio data is representative of audio associated with an environment at a first time. The method can comprise labeling, by the server device, the audio data with the first time, resulting in labeled audio data in response to the receiving the real-time audio data. At a second time later than the first time, the method can comprise receiving, by the server device, request data representative of a request for the real-time audio data received at the first time. Additionally, in response to the receiving the request data, the method can comprise sending, by the server device via a wireless network, the real-time audio data for presentation during an augmented reality simulation of aspects of the environment associated with the first time.

According to another embodiment, a system can facilitate receiving first audio data representative of first audio associated with an environment at a first time. In response to the receiving the first audio data, the system can comprise labeling the first audio data, resulting in labeled audio data. At a second time, different from the first time, the system can comprise receiving, request data representative of a request for the first audio data at the first time. Furthermore, in response to the receiving the request data, the system can comprise sending, the first audio data to an augmented reality device for output via the augmented reality device during a simulation of the environment associated with the first time.

According to yet another embodiment, described herein is a machine-readable medium that can perform the operations comprising facilitating labeling the first audio data, resulting in labeled audio data in response to receiving first audio data representative of first audio associated with an environment. Additionally, in response to receiving request data representative of a request for audio data, the machine-readable medium can perform the operations comprising facilitating sending an audio file to an augmented reality device for render during a utilization of the augmented reality device.

These and other embodiments or implementations are described in more detail below with reference to the drawings.

Referring now to FIG. 1, illustrated is an example wireless communication system 100 in accordance with various aspects and embodiments of the subject disclosure. In one or more embodiments, system 100 can comprise one or more user equipment UEs 102. The non-limiting term user equipment can refer to any type of device that can communicate with a network node in a cellular or mobile communication system. A UE can have one or more antenna panels having vertical and horizontal elements. Examples of a UE comprise a target device, device to device (D2D) UE, machine type UE or UE capable of machine to machine (M2M) communications, personal digital assistant (PDA), tablet, mobile terminals, smart phone, laptop mounted equipment (LME), universal serial bus (USB) dongles enabled for mobile communications, a computer having mobile capabilities, a mobile device such as cellular phone, a laptop having laptop embedded equipment (LEE, such as a mobile broadband adapter), a tablet computer having a mobile broadband adapter, a wearable device, a virtual reality (VR) device, a heads-up display (HUD) device, a smart car, a machine-type communication (MTC) device, and the like. User equipment UE 102 can also comprise IOT devices that communicate wirelessly.

In various embodiments, system 100 is or comprises a wireless communication network serviced by one or more wireless communication network providers. In example embodiments, a UE 102 can be communicatively coupled to the wireless communication network via a network node 104. The network node (e.g., network node device) can communicate with user equipment (UE), thus providing connectivity between the UE and the wider cellular network. The UE 102 can send transmission type recommendation data to the network node 104. The transmission type recommendation data can comprise a recommendation to transmit data via a closed loop MIMO mode and/or a rank-1 precoder mode.

A network node can have a cabinet and other protected enclosures, an antenna mast, and multiple antennas for performing various transmission operations (e.g., MIMO operations). Network nodes can serve several cells, also called sectors, depending on the configuration and type of antenna. In example embodiments, the UE 102 can send and/or receive communication data via a wireless link to the network node 104. The dashed arrow lines from the network node 104 to the UE 102 represent downlink (DL) communications and the solid arrow lines from the UE 102 to the network nodes 104 represents an uplink (UL) communication.

System 100 can further include one or more communication service provider networks 106 that facilitate providing wireless communication services to various UEs, including UE 102, via the network node 104 and/or various additional network devices (not shown) included in the one or more communication service provider networks 106. The one or more communication service provider networks 106 can include various types of disparate networks, including but not limited to: cellular networks, femto networks, picocell networks, microcell networks, internet protocol (IP) networks Wi-Fi service networks, broadband service network, enterprise networks, cloud based networks, and the like. For example, in at least one implementation, system 100 can be or include a large scale wireless communication network that spans various geographic areas. According to this implementation, the one or more communication service provider networks 106 can be or include the wireless communication network and/or various additional devices and components of the wireless communication network (e.g., additional network devices and cell, additional UEs, network server devices, etc.). The network node 104 can be connected to the one or more communication service provider networks 106 via one or more backhaul links 108. For example, the one or more backhaul links 108 can comprise wired link components, such as a T1/E1 phone line, a digital subscriber line (DSL) (e.g., either synchronous or asynchronous), an asymmetric DSL (ADSL), an optical fiber backbone, a coaxial cable, and the like. The one or more backhaul links 108 can also include wireless link components, such as but not limited to, line-of-sight (LOS) or non-LOS links which can include terrestrial air-interfaces or deep space links (e.g., satellite communication links for navigation).

Wireless communication system 100 can employ various cellular systems, technologies, and modulation modes to facilitate wireless radio communications between devices (e.g., the UE 102 and the network node 104). While example embodiments might be described for 5G new radio (NR) systems, the embodiments can be applicable to any radio access technology (RAT) or multi-RAT system where the UE operates using multiple carriers e.g. LTE FDD/TDD, GSM/GERAN, CDMA2000 etc.

For example, system 100 can operate in accordance with global system for mobile communications (GSM), universal mobile telecommunications service (UMTS), long term evolution (LTE), LTE frequency division duplexing (LTE FDD, LTE time division duplexing (TDD), high speed packet access (HSPA), code division multiple access (CDMA), wideband CDMA (WCMDA), CDMA2000, time division multiple access (TDMA), frequency division multiple access (FDMA), multi-carrier code division multiple access (MC-CDMA), single-carrier code division multiple access (SC-CDMA), single-carrier FDMA (SC-FDMA), orthogonal frequency division multiplexing (OFDM), discrete Fourier transform spread OFDM (DFT-spread OFDM) single carrier FDMA (SC-FDMA), Filter bank based multi-carrier (FBMC), zero tail DFT-spread-OFDM (ZT DFT-s-OFDM), generalized frequency division multiplexing (GFDM), fixed mobile convergence (FMC), universal fixed mobile convergence (UFMC), unique word OFDM (UW-OFDM), unique word DFT-spread OFDM (UW DFT-Spread-OFDM), cyclic prefix OFDM CP-OFDM, resource-block-filtered OFDM, Wi Fi, WLAN, WiMax, and the like. However, various features and functionalities of system 100 are particularly described wherein the devices (e.g., the UEs 102 and the network device 104) of system 100 are configured to communicate wireless signals using one or more multi carrier modulation schemes, wherein data symbols can be transmitted simultaneously over multiple frequency subcarriers (e.g., OFDM, CP-OFDM, DFT-spread OFMD, UFMC, FMBC, etc.). The embodiments are applicable to single carrier as well as to multicarrier (MC) or carrier aggregation (CA) operation of the UE. The term carrier aggregation (CA) is also called (e.g. interchangeably called) "multi-carrier system", "multi-cell operation", "multi-carrier operation", "multi-carrier" transmission and/or reception. Note that some embodiments are also applicable for Multi RAB (radio bearers) on some carriers (that is data plus speech is simultaneously scheduled).

In various embodiments, system 100 can be configured to provide and employ 5G wireless networking features and functionalities. 5G wireless communication networks are expected to fulfill the demand of exponentially increasing data traffic and to allow people and machines to enjoy gigabit data rates with virtually zero latency. Compared to 4G, 5G supports more diverse traffic scenarios. For example, in addition to the various types of data communication between conventional UEs (e.g., phones, smartphones, tablets, PCs, televisions, Internet enabled televisions, etc.) supported by 4G networks, 5G networks can be employed to support data communication between smart cars in association with driverless car environments, as well as machine type communications (MTCs). Considering the drastic different communication needs of these different traffic scenarios, the ability to dynamically configure waveform parameters based on traffic scenarios while retaining the benefits of multi carrier modulation schemes (e.g., OFDM and related schemes) can provide a significant contribution to the high speed/capacity and low latency demands of 5G networks. With waveforms that split the bandwidth into several sub-bands, different types of services can be accommodated in different sub-bands with the most suitable waveform and numerology, leading to an improved spectrum utilization for 5G networks.

To meet the demand for data centric applications, features of proposed 5G networks may comprise: increased peak bit rate (e.g., 20 Gbps), larger data volume per unit area (e.g., high system spectral efficiency—for example about 3.5 times that of spectral efficiency of long term evolution (LTE)

systems), high capacity that allows more device connectivity both concurrently and instantaneously, lower battery/power consumption (which reduces energy and consumption costs), better connectivity regardless of the geographic region in which a user is located, a larger numbers of devices, lower infrastructural development costs, and higher reliability of the communications. Thus, 5G networks may allow for: data rates of several tens of megabits per second should be supported for tens of thousands of users, 1 gigabit per second to be offered simultaneously to tens of workers on the same office floor, for example; several hundreds of thousands of simultaneous connections to be supported for massive sensor deployments; improved coverage, enhanced signaling efficiency; reduced latency compared to LTE.

The upcoming 5G access network may utilize higher frequencies (e.g., >6 GHz) to aid in increasing capacity. Currently, much of the millimeter wave (mmWave) spectrum, the band of spectrum between 30 gigahertz (Ghz) and 300 Ghz is underutilized. The millimeter waves have shorter wavelengths that range from 10 millimeters to 1 millimeter, and these mmWave signals experience severe path loss, penetration loss, and fading. However, the shorter wavelength at mmWave frequencies also allows more antennas to be packed in the same physical dimension, which allows for large-scale spatial multiplexing and highly directional beamforming.

Performance can be improved if both the transmitter and the receiver are equipped with multiple antennas. Multi-antenna techniques can significantly increase the data rates and reliability of a wireless communication system. The use of multiple input multiple output (MIMO) techniques, which was introduced in the third-generation partnership project (3GPP) and has been in use (including with LTE), is a multi-antenna technique that can improve the spectral efficiency of transmissions, thereby significantly boosting the overall data carrying capacity of wireless systems. The use of multiple-input multiple-output (MIMO) techniques can improve mmWave communications, and has been widely recognized a potentially important component for access networks operating in higher frequencies. MIMO can be used for achieving diversity gain, spatial multiplexing gain and beamforming gain. For these reasons, MIMO systems are an important part of the 3rd and 4th generation wireless systems, and are planned for use in 5G systems.

Figure 2:
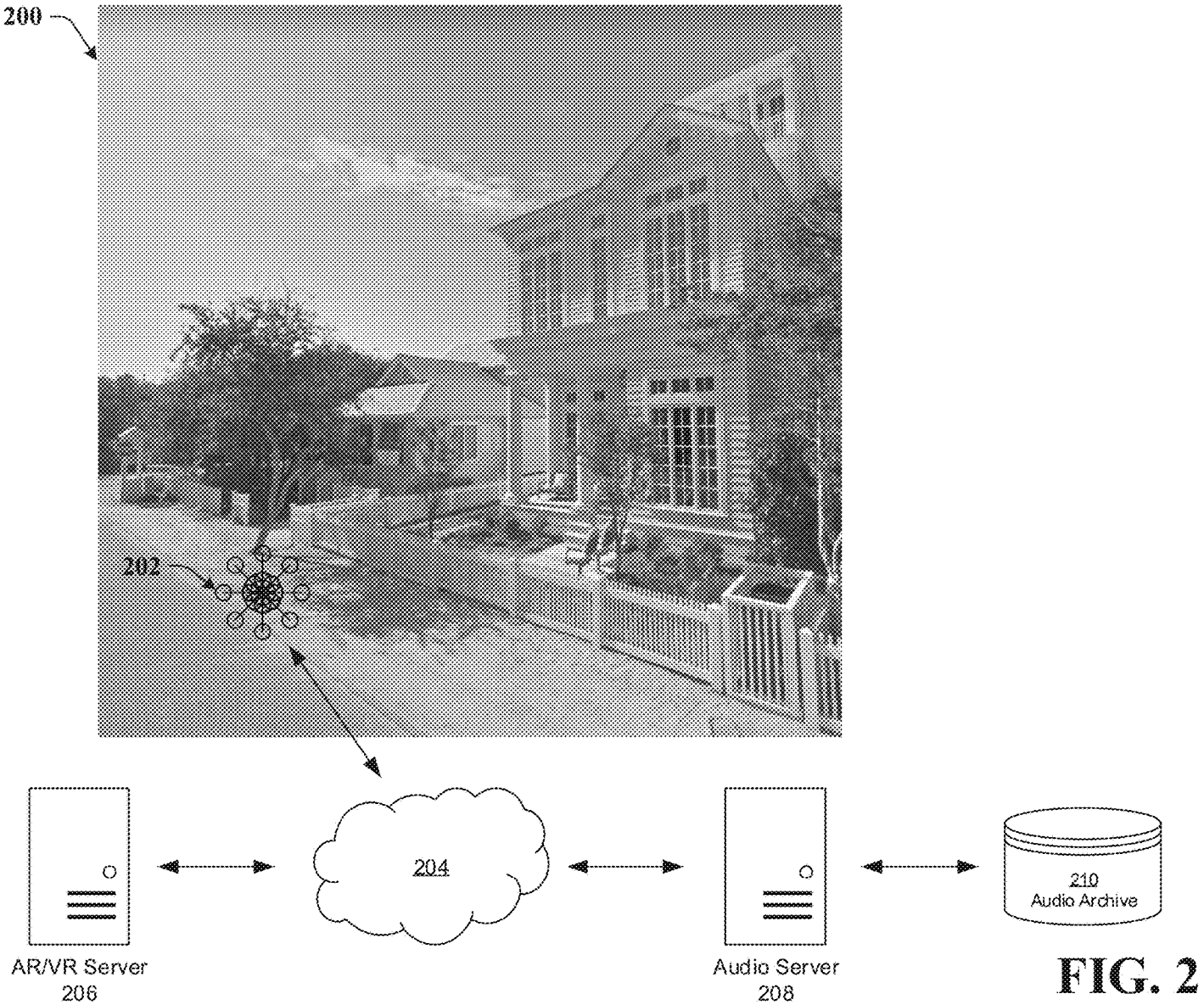
FIG. 2 illustrates an example schematic system block diagram of a system for audio for AR according to one or more embodiments.

Referring now to FIG. 2, illustrated is an example schematic system block diagram of a system 200 for audio for AR according to one or more embodiments.

A microphone 202 or other audio device can be positioned to capture ambient audio at a location. The microphone can also be a part of a mobile device (e.g., a smartphone, smartwatch, or other networked personal device) that is at or near the location. A camera can also be a part of a UE 102 camera that traverses interiors or exteriors in order to capture video to be used for navigation purposes. The microphone 202 can have a unique network identification (ID) such as an internet protocol (IP) address and it can be location aware so that it can identify its location (e.g., via latitude and/or longitude coordinates) at a point in time. Audio received by the microphone 202 can be sent to a server device 204 of a cloud-based network, where it can be stored by an audio server 208. Other metadata can also be stored, such as a source ID to identify a person or entity that provided the audio file. If the microphone was in motion during the audio capture, the audio server can calculate an average location, $X_{avg}$, $Y_{avg}$. The audio server 208 can label, parse, and/or separate the audio data into several categories based on: content, timestamps, location, source ID, and/or other metadata. The labeled audio data can be communicated to/from the audio server 208 to an audio repository 210. Consequently, when an AR device 500 initiates an AR view of a specific area, an AR/VR server 206 can request the corresponding audio data from the server device 204, thus prompting the audio server 208 to provide the relevant audio data from the audio repository 210 based on the labeled categories that correspond to the AR view.

Figure 3:
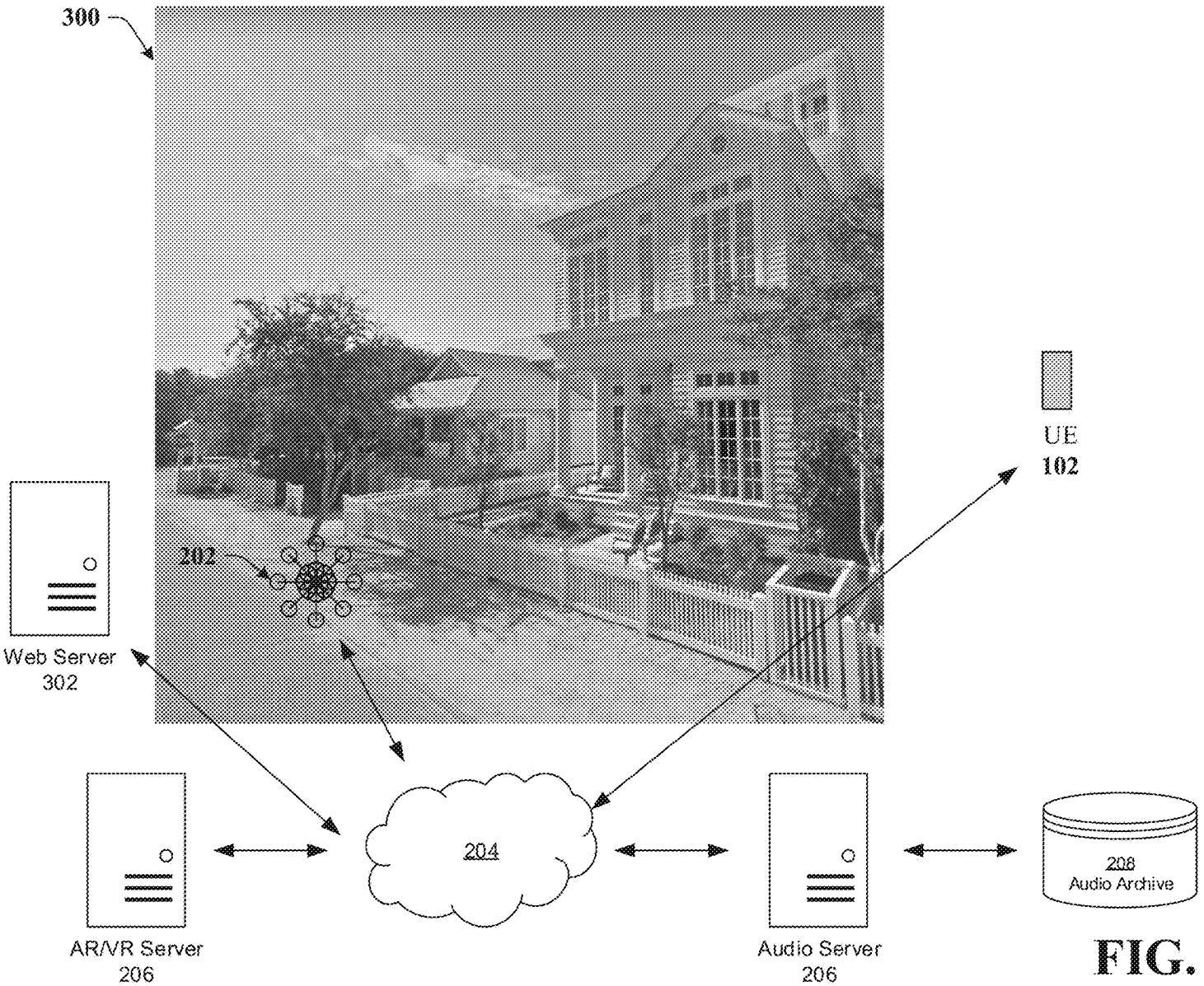
FIG. 3 illustrates an example schematic system block diagram of a system for audio for AR comprising an end-user device according to one or more embodiments.

Referring now to FIG. 3, illustrated is an example schematic system block diagram of a system 300 for audio for AR comprising an end-user device according to one or more embodiments.

In another embodiment, an internet user can log into a web server 302 to view a location via the UE 102. The viewer can be searching a neighborhood and want to hear what the ambient noise is typically like. The audio server 208 can be queried with a location ID and be asked to return the most recent audio recording created nearest to the location. The audio server 208 can return the audio for presentation to the user, including data that can be used to present information about the audio that is playing. The audio can thus be from a separate source than the visual display. This solution can also present live audio to the internet user via the UE 102. In this case, an audio source (e.g., microphone 202) can identify itself as live streaming, and the audio content in the audio archive can be tagged as a live stream. The live streaming audio can be presented to the user via the UE 102, and the user's display can reflect an indication that the audio playing to them is a live stream. Again, this audio can be from a separate source than an AR display.

From the UE 102, the internet user can modify the time parameters to simulate what the ambient noise in the area is like in the future or what it was like in the past. The internet user can also modify parameters to request that any notable noise events, perhaps above a certain decibel level, are presented to the user. The system can also be used to create simulated audio that is representative of a point in time when an actual audio recording does not exist. Options can be presented to the user to select a time and date for the simulated audio. The time and date selected by the user can be in the past or in the future. The time and date selected, along with the location, can be sent to the audio server. If it finds an actual recording corresponding to the time and location requested in the audio archive, the audio content can be retrieved and sent to the internet user for presentation.

Figure 4:
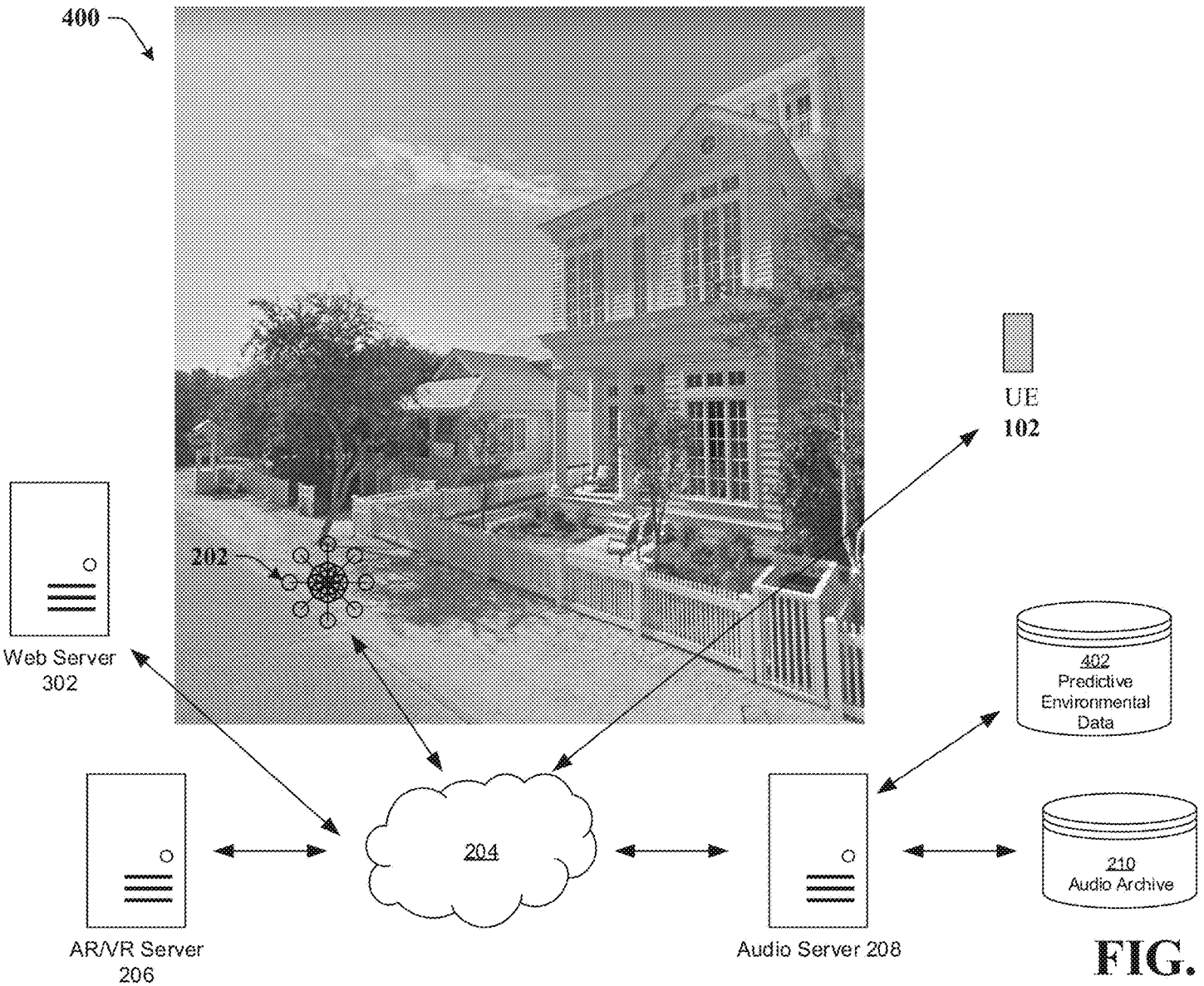
FIG. 4 illustrates an example schematic system block diagram of a system for audio for AR comprising predictive data according to one or more embodiments.

Referring now to FIG. 4, illustrated is an example schematic system block diagram of a system 400 for audio for AR comprising predictive data according to one or more embodiments.

If no actual audio content is found for the user-selected time, date, and/or location requested, the audio server 208 can create a simulated audio file to be presented to the user. For instance, if the user is conducting the search in the year 2020 and wishes to hear a simulation of the ambient noise in the year 2030, they can make that request via the UE 102. The audio server 208 can use the audio content from the audio archive 210 that is the closest in time and location to the actual request as a baseline. To modify this baseline audio, the audio server 208 can access predictive environmental (PE) data from one or more sources (e.g., PE repository 402). The PE data can comprise data that represents planned or predicted trends for the area.

To create the simulated audio, the audio server 208 can use the baseline audio and mix in supplemental audio from a library. For instance, if a construction project is planned during the time requested, simulated construction sounds can be added to the baseline audio. The audio server 208 can also sample the traffic noise from the baseline audio and increase or decrease its volume and/or frequency by a percentage value, for example. The resulting baseline audio, now modified, can be sent by the audio server 208 for presentation to the internet user via the UE 102.

Figure 5:
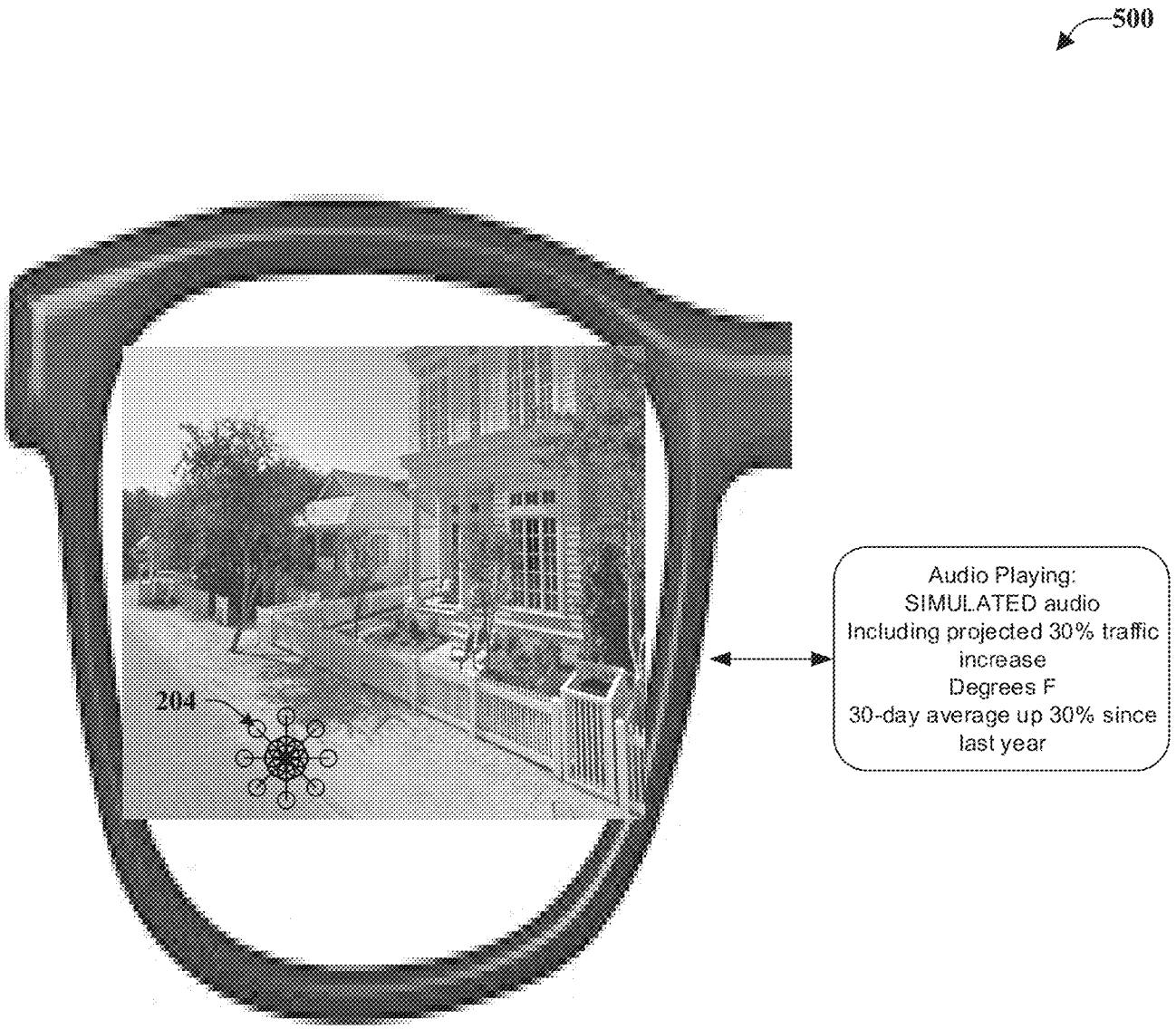
FIG. 5 illustrates an example schematic system block diagram of a system for an AR device according to one or more embodiments.

Referring now to FIG. 5 illustrates an example schematic system block diagram of an AR device 500 according to one or more embodiments.

The audio server 208 can create or retrieve audio to send to a user in the same manner if the user is participating in an augmented reality or virtual reality experience. In the case of AR, the video content presented to the user via the AR device 500 can have a location ID associated with it that represents the real-world location. In the case of AR, the AR device 500 can be used to determine the location being viewed and send the location with the request for audio to the audio server 208.

Figure 6:
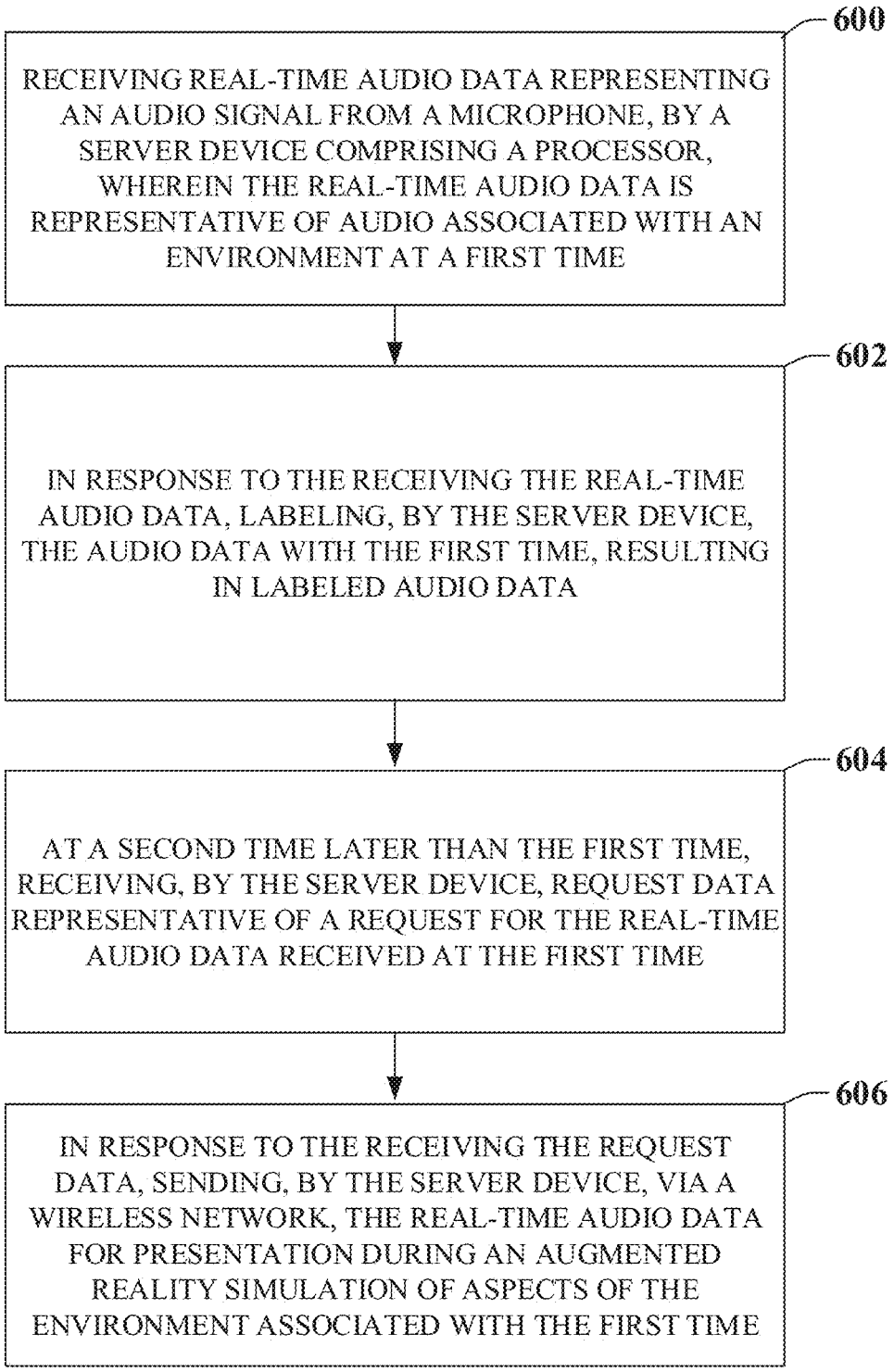
FIG. 6 illustrates an example flow diagram for a method for facilitating audio for according to one or more embodiments.
Figure 7:
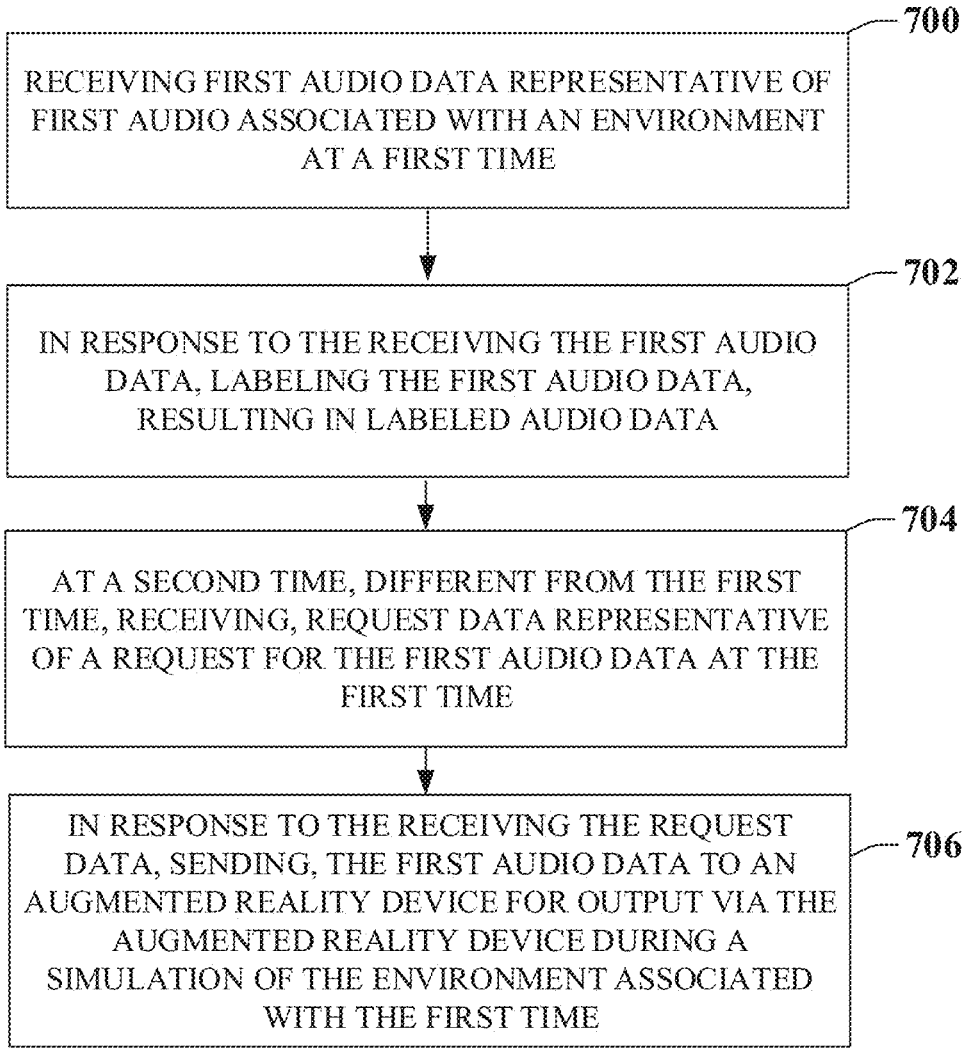
FIG. 7 illustrates an example flow diagram for a system for facilitating audio for according to one or more embodiments.

Referring now to FIG. 6, illustrated is an example flow diagram for a method for facilitating audio for according to one or more embodiments. At element 600, the method can comprise receiving real-time audio data representing an audio signal from a microphone, by a server device comprising a processor, wherein the real-time audio data is representative of audio associated with an environment at a first time. At element 602, the method can comprise labeling, by the server device, the audio data with the first time, resulting in labeled audio data in response to the receiving the real-time audio data. At a second time later than the first time, at element 604, the method can comprise receiving, by the server device, request data representative of a request for the real-time audio data received at the first time. Additionally, in response to the receiving the request data, at element 606, the method can comprise sending, by the server device via a wireless network, the real-time audio data for presentation during an augmented reality simulation of aspects of the environment associated with the first time Referring now to FIG. 7, illustrated is an example flow diagram for a system for facilitating audio for according to one or more embodiments. At element 700, the system can facilitate receiving first audio data representative of first audio associated with an environment at a first time. In response to the receiving the first audio data, the system can comprise labeling the first audio data, resulting in labeled audio data. At a second time, different from the first time, at element 702, the system can comprise receiving, request data representative of a request for the first audio data at the first time. Furthermore, in response to the receiving the request data, at element 704, the system can comprise sending, the first audio data to an augmented reality device for output via the augmented reality device during a simulation of the environment associated with the first time.

Figure 8:
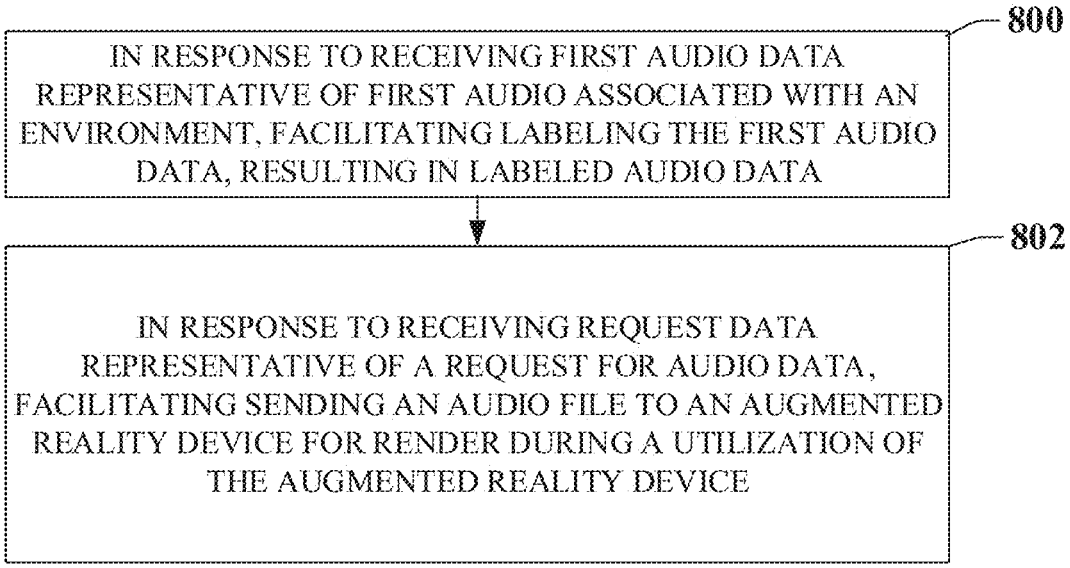
FIG. 8 illustrates an example flow diagram for a machine-readable medium for facilitating audio for according to one or more embodiments.

Referring now to FIG. 8, illustrated is an example flow diagram for a machine-readable medium for facilitating audio for according to one or more embodiments. At element 800, the machine-readable medium that can perform the operations comprising facilitating labeling the first audio data, resulting in labeled audio data in response to receiving first audio data representative of first audio associated with an environment. Additionally, at element 802, in response to receiving request data representative of a request for audio data, the machine-readable medium can perform the operations comprising facilitating sending an audio file to an augmented reality device for render during a utilization of the augmented reality device.

Figure 9:
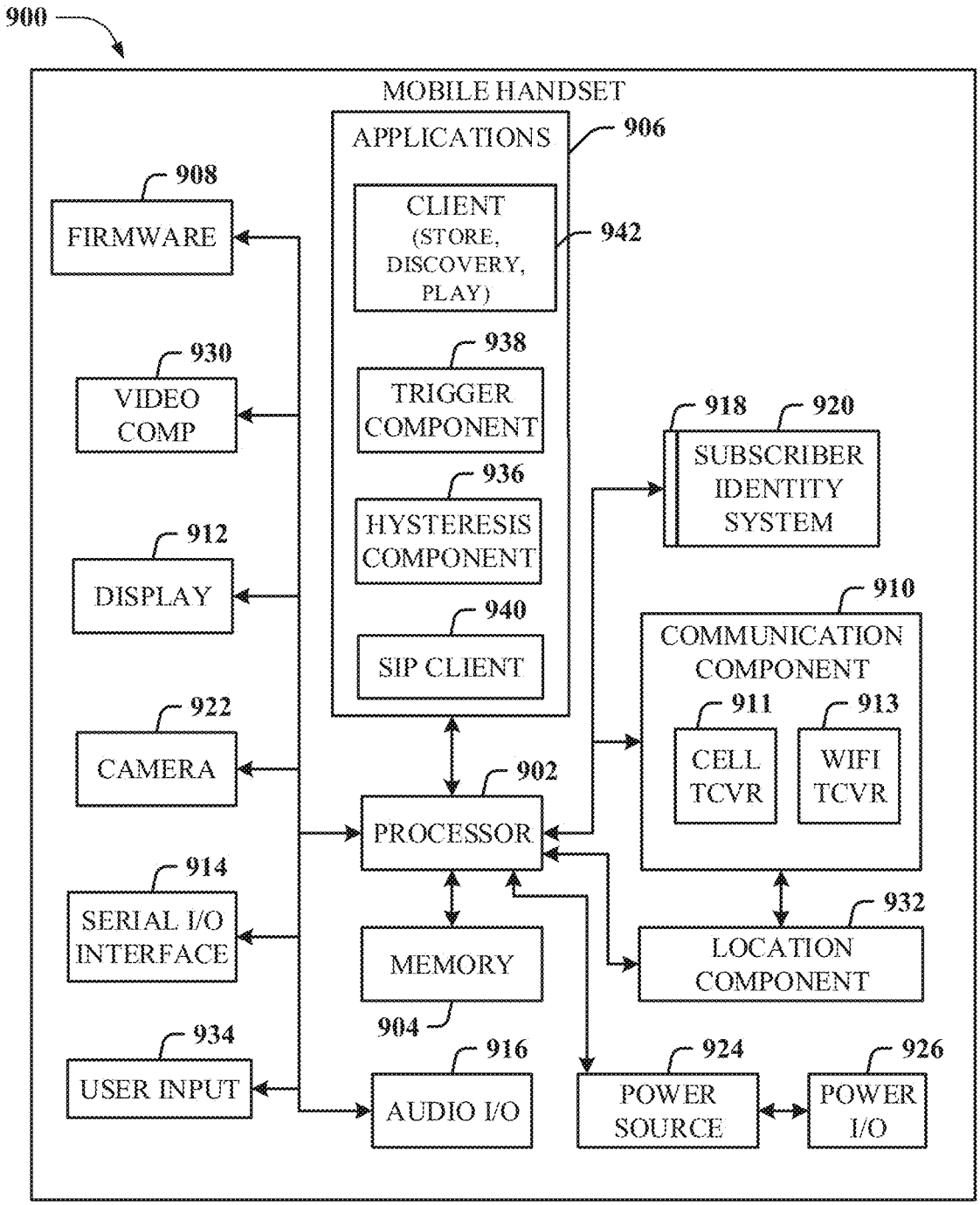
FIG. 9 illustrates an example block diagram of an example mobile handset operable to engage in a system architecture that facilitates secure wireless communication according to one or more embodiments described herein.

Referring now to FIG. 9, illustrated is a schematic block diagram of an exemplary end-user device such as a mobile device capable of connecting to a network in accordance with some embodiments described herein. Although a mobile handset 900 is illustrated herein, it will be understood that other devices can be a mobile device, and that the mobile handset 900 is merely illustrated to provide context for the embodiments of the various embodiments described herein. The following discussion is intended to provide a brief, general description of an example of a suitable environment 900 in which the various embodiments can be implemented. While the description includes a general context of computer-executable instructions embodied on a machine-readable storage medium, those skilled in the art will recognize that the innovation also can be implemented in combination with other program modules and/or as a combination of hardware and software.

Generally, applications (e.g., program modules) can include routines, programs, components, data structures, etc., that perform particular tasks or implement particular abstract data types. Moreover, those skilled in the art will appreciate that the methods described herein can be practiced with other system configurations, including single-processor or multiprocessor systems, minicomputers, mainframe computers, as well as personal computers, hand-held computing devices, microprocessor-based or programmable consumer electronics, and the like, each of which can be operatively coupled to one or more associated devices.

A computing device can typically include a variety of machine-readable media. Machine-readable media can be any available media that can be accessed by the computer and includes both volatile and non-volatile media, removable and non-removable media. By way of example and not limitation, computer-readable media can comprise computer storage media and communication media. Computer storage media can include volatile and/or non-volatile media, removable and/or non-removable media implemented in any method or technology for storage of information, such as computer-readable instructions, data structures, program modules or other data. Computer storage media can include, but is not limited to, RAM, ROM, EEPROM, flash memory or other memory technology, CD ROM, digital video disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

The handset 900 includes a processor 902 for controlling and processing all onboard operations and functions. A memory 904 interfaces to the processor 902 for storage of data and one or more applications 906 (e.g., a video player software, user feedback component software, etc.). Other applications can include voice recognition of predetermined voice commands that facilitate initiation of the user feedback signals. The applications 906 can be stored in the memory 904 and/or in a firmware 908, and executed by the processor 902 from either or both the memory 904 or/and the firmware 908. The firmware 908 can also store startup code for execution in initializing the handset 900. A communications component 910 interfaces to the processor 902 to facilitate wired/wireless communication with external systems, e.g., cellular networks, VoIP networks, and so on. Here, the communications component 910 can also include a suitable cellular transceiver 911 (e.g., a GSM transceiver) and/or an unlicensed transceiver 913 (e.g., Wi-Fi, WiMax) for corresponding signal communications. The handset 900 can be a device such as a cellular telephone, a PDA with mobile communications capabilities, and messaging-centric devices. The communications component 910 also facilitates communications reception from terrestrial radio networks (e.g., broadcast), digital satellite radio networks, and Internet-based radio services networks.

The handset 900 includes a display 912 for displaying text, images, video, telephony functions (e.g., a Caller ID function), setup functions, and for user input. For example, the display 912 can also be referred to as a "screen" that can accommodate the presentation of multimedia content (e.g., music metadata, messages, wallpaper, graphics, etc.). The display 912 can also display videos and can facilitate the generation, editing and sharing of video quotes. A serial I/O interface 914 is provided in communication with the processor 902 to facilitate wired and/or wireless serial communications (e.g., USB, and/or IEEE 1394) through a hardwire connection, and other serial input devices (e.g., a keyboard, keypad, and mouse). This supports updating and troubleshooting the handset 900, for example. Audio capabilities are provided with an audio I/O component 916, which can include a speaker for the output of audio signals related to, for example, indication that the user pressed the proper key or key combination to initiate the user feedback signal. The audio I/O component 916 also facilitates the input of audio signals through a microphone to record data and/or telephony voice data, and for inputting voice signals for telephone conversations.

The handset 900 can include a slot interface 918 for accommodating a SIC (Subscriber Identity Component) in the form factor of a card Subscriber Identity Module (SIM) or universal SIM 920, and interfacing the SIM card 920 with the processor 902. However, it is to be appreciated that the SIM card 920 can be manufactured into the handset 900, and updated by downloading data and software.

The handset 900 can process IP data traffic through the communication component 910 to accommodate IP traffic from an IP network such as, for example, the Internet, a corporate intranet, a home network, a person area network, etc., through an ISP or broadband cable provider. Thus, VoIP traffic can be utilized by the handset 900 and IP-based multimedia content can be received in either an encoded or decoded format.

A video processing component 922 (e.g., a camera) can be provided for decoding encoded multimedia content. The video processing component 922 can aid in facilitating the generation, editing and sharing of video quotes. The handset 900 also includes a power source 924 in the form of batteries and/or an AC power subsystem, which power source 924 can interface to an external power system or charging equipment (not shown) by a power I/O component 926.

The handset 900 can also include a video component 930 for processing video content received and, for recording and transmitting video content. For example, the video component 930 can facilitate the generation, editing and sharing of video quotes. A location tracking component 932 facilitates geographically locating the handset 900. As described hereinabove, this can occur when the user initiates the feedback signal automatically or manually. A user input component 934 facilitates the user initiating the quality feedback signal. The user input component 934 can also facilitate the generation, editing and sharing of video quotes. The user input component 934 can include such conventional input device technologies such as a keypad, keyboard, mouse, stylus pen, and/or touch screen, for example.

Referring again to the applications 906, a hysteresis component 936 facilitates the analysis and processing of hysteresis data, which is utilized to determine when to associate with the access point. A software trigger component 938 can be provided that facilitates triggering of the hysteresis component 938 when the Wi-Fi transceiver 913 detects the beacon of the access point. A SIP client 940 enables the handset 900 to support SIP protocols and register the subscriber with the SIP registrar server. The applications 906 can also include a client 942 that provides at least the capability of discovery, play and store of multimedia content, for example, music.

The handset 900, as indicated above related to the communications component 910, includes an indoor network radio transceiver 913 (e.g., Wi-Fi transceiver). This function supports the indoor radio link, such as IEEE 802.11, for the dual-mode GSM handset 900. The handset 900 can accommodate at least satellite radio services through a handset that can combine wireless voice and digital radio chipsets into a single handheld device.

Figure 10:
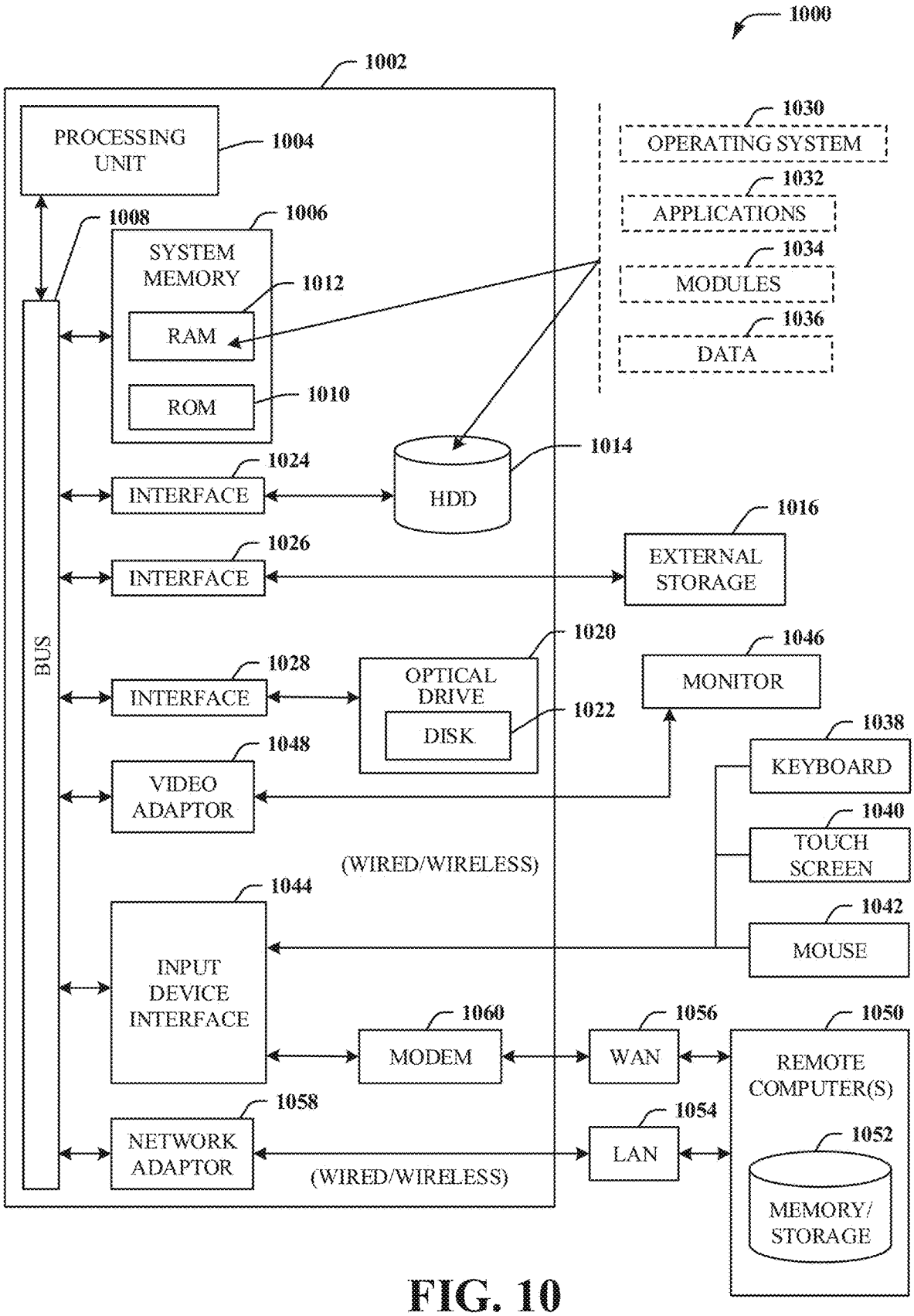
FIG. 10 illustrates an example block diagram of an example computer operable to engage in a system architecture that facilitates secure wireless communication according to one or more embodiments described herein.

In order to provide additional context for various embodiments described herein, FIG. 10 and the following discussion are intended to provide a brief, general description of a suitable computing environment 1000 in which the various embodiments of the embodiment described herein can be implemented. While the embodiments have been described above in the general context of computer-executable instructions that can run on one or more computers, those skilled in the art will recognize that the embodiments can be also implemented in combination with other program modules and/or as a combination of hardware and software.

Generally, program modules include routines, programs, components, data structures, etc., that perform particular tasks or implement particular abstract data types. Moreover, those skilled in the art will appreciate that the disclosed methods can be practiced with other computer system configurations, including single-processor or multiprocessor computer systems, minicomputers, mainframe computers, Internet of Things (IoT) devices, distributed computing systems, as well as personal computers, hand-held computing devices, microprocessor-based or programmable consumer electronics, and the like, each of which can be operatively coupled to one or more associated devices.

The illustrated embodiments of the embodiments herein can be also practiced in distributed computing environments where certain tasks are performed by remote processing devices that are linked through a communications network. In a distributed computing environment, program modules can be located in both local and remote memory storage devices.

Computing devices typically include a variety of media, which can include computer-readable storage media, machine-readable storage media, and/or communications media, which two terms are used herein differently from one another as follows. Computer-readable storage media or machine-readable storage media can be any available storage media that can be accessed by the computer and includes both volatile and nonvolatile media, removable and nonremovable media. By way of example, and not limitation, computer-readable storage media or machine-readable storage media can be implemented in connection with any method or technology for storage of information such as computer-readable or machine-readable instructions, program modules, structured data or unstructured data.

Computer-readable storage media can include, but are not limited to, random access memory (RAM), read only memory (ROM), electrically erasable programmable read only memory (EEPROM), flash memory or other memory technology, compact disk read only memory (CD-ROM), digital versatile disk (DVD), Blu-ray disc (BD) or other optical disk storage, magnetic cassettes, magnetic tape, magnetic disk storage or other magnetic storage devices, solid state drives or other solid state storage devices, or other tangible and/or non-transitory media which can be used to store desired information. In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se.

Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

With reference again to FIG. 10, the example environment 1000 for implementing various embodiments of the aspects described herein includes a computer 1002, the computer 1002 including a processing unit 1004, a system memory 1006 and a system bus 1008. The system bus 1008 couples system components including, but not limited to, the system memory 1006 to the processing unit 1004. The processing unit 1004 can be any of various commercially available processors. Dual microprocessors and other multi-processor architectures can also be employed as the processing unit 1004.

The system bus 1008 can be any of several types of bus structure that can further interconnect to a memory bus (with or without a memory controller), a peripheral bus, and a local bus using any of a variety of commercially available bus architectures. The system memory 1006 includes ROM 1010 and RAM 1012. A basic input/output system (BIOS) can be stored in a non-volatile memory such as ROM, erasable programmable read only memory (EPROM), EEPROM, which BIOS contains the basic routines that help to transfer information between elements within the computer 1002, such as during startup. The RAM 1012 can also include a high-speed RAM such as static RAM for caching data.

The computer 1002 further includes an internal hard disk drive (HDD) 1014 (e.g., EIDE, SATA), one or more external storage devices 1016 (e.g., a magnetic floppy disk drive (FDD) 1016, a memory stick or flash drive reader, a memory card reader, etc.) and an optical disk drive 1020 (e.g., which can read or write from a CD-ROM disc, a DVD, a BD, etc.). While the internal HDD 1014 is illustrated as located within the computer 1002, the internal HDD 1014 can also be configured for external use in a suitable chassis (not shown). Additionally, while not shown in environment 1000, a solid state drive (SSD) could be used in addition to, or in place of, an HDD 1014. The HDD 1014, external storage device(s) 1016 and optical disk drive 1020 can be connected to the system bus 1008 by an HDD interface 1024, an external storage interface 1026 and an optical drive interface 1028, respectively. The interface 1024 for external drive implementations can include at least one or both of Universal Serial Bus (USB) and Institute of Electrical and Electronics Engineers (IEEE) 1394 interface technologies. Other external drive connection technologies are within contemplation of the embodiments described herein.

The drives and their associated computer-readable storage media provide nonvolatile storage of data, data structures, computer-executable instructions, and so forth. For the computer 1002, the drives and storage media accommodate the storage of any data in a suitable digital format. Although the description of computer-readable storage media above refers to respective types of storage devices, it should be appreciated by those skilled in the art that other types of storage media which are readable by a computer, whether presently existing or developed in the future, could also be used in the example operating environment, and further, that any such storage media can contain computer-executable instructions for performing the methods described herein.

A number of program modules can be stored in the drives and RAM 1012, including an operating system 1030, one or more application programs 1032, other program modules 1034 and program data 1036. All or portions of the operating system, applications, modules, and/or data can also be cached in the RAM 1012. The systems and methods described herein can be implemented utilizing various commercially available operating systems or combinations of operating systems.

Computer 1002 can optionally comprise emulation technologies. For example, a hypervisor (not shown) or other intermediary can emulate a hardware environment for operating system 1030, and the emulated hardware can optionally be different from the hardware illustrated in FIG. 10. In such an embodiment, operating system 1030 can comprise one virtual machine (VM) of multiple VMs hosted at computer 1002. Furthermore, operating system 1030 can provide runtime environments, such as the Java runtime environment or the .NET framework, for applications 1032. Runtime environments are consistent execution environments that allow applications 1032 to run on any operating system that includes the runtime environment. Similarly, operating system 1030 can support containers, and applications 1032 can be in the form of containers, which are lightweight, standalone, executable packages of software that include, e.g., code, runtime, system tools, system libraries and settings for an application.

Further, computer 1002 can be enable with a security module, such as a trusted processing module (TPM). For instance with a TPM, boot components hash next in time boot components, and wait for a match of results to secured values, before loading a next boot component. This process can take place at any layer in the code execution stack of computer 1002, e.g., applied at the application execution level or at the operating system (OS) kernel level, thereby enabling security at any level of code execution.

A user can enter commands and information into the computer 1002 through one or more wired/wireless input devices, e.g., a keyboard 1038, a touch screen 1040, and a pointing device, such as a mouse 1042. Other input devices (not shown) can include a microphone, an infrared (IR) remote control, a radio frequency (RF) remote control, or other remote control, a joystick, a virtual reality controller and/or virtual reality headset, a game pad, a stylus pen, an image input device, e.g., camera(s), a gesture sensor input device, a vision movement sensor input device, an emotion or facial detection device, a biometric input device, e.g., fingerprint or iris scanner, or the like. These and other input devices are often connected to the processing unit 1004 through an input device interface 1044 that can be coupled to the system bus 1008, but can be connected by other interfaces, such as a parallel port, an IEEE 1394 serial port, a game port, a USB port, an IR interface, a BLUETOOTH® interface, etc.

A monitor 1046 or other type of display device can be also connected to the system bus 1008 via an interface, such as a video adapter 1048. In addition to the monitor 1046, a computer typically includes other peripheral output devices (not shown), such as speakers, printers, etc.

The computer 1002 can operate in a networked environment using logical connections via wired and/or wireless communications to one or more remote computers, such as a remote computer(s) 1050. The remote computer(s) 1050 can be a workstation, a server computer, a router, a personal computer, portable computer, microprocessor-based entertainment appliance, a peer device or other common network node, and typically includes many or all of the elements described relative to the computer 1002, although, for purposes of brevity, only a memory/storage device 1052 is illustrated. The logical connections depicted include wired/wireless connectivity to a local area network (LAN) 1054 and/or larger networks, e.g., a wide area network (WAN) 1056. Such LAN and WAN networking environments are commonplace in offices and companies, and facilitate enterprise-wide computer networks, such as intranets, all of which can connect to a global communications network, e.g., the Internet.

When used in a LAN networking environment, the computer 1002 can be connected to the local network 1054 through a wired and/or wireless communication network interface or adapter 1058. The adapter 1058 can facilitate wired or wireless communication to the LAN 1054, which can also include a wireless access point (AP) disposed thereon for communicating with the adapter 1058 in a wireless mode.

When used in a WAN networking environment, the computer 1002 can include a modem 1060 or can be connected to a communications server on the WAN 1056 via other means for establishing communications over the WAN 1056, such as by way of the Internet. The modem 1060, which can be internal or external and a wired or wireless device, can be connected to the system bus 1008 via the input device interface 1044. In a networked environment, program modules depicted relative to the computer 1002 or portions thereof, can be stored in the remote memory/storage device 1052. It will be appreciated that the network connections shown are example and other means of establishing a communications link between the computers can be used.

When used in either a LAN or WAN networking environment, the computer 1002 can access cloud storage systems or other network-based storage systems in addition to, or in place of, external storage devices 1016 as described above. Generally, a connection between the computer 1002 and a cloud storage system can be established over a LAN 1054 or WAN 1056 e.g., by the adapter 1058 or modem 1060, respectively. Upon connecting the computer 1002 to an associated cloud storage system, the external storage interface 1026 can, with the aid of the adapter 1058 and/or modem 1060, manage storage provided by the cloud storage system as it would other types of external storage. For instance, the external storage interface 1026 can be configured to provide access to cloud storage sources as if those sources were physically connected to the computer 1002.

The computer 1002 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, store shelf, etc.), and telephone. This can include Wireless Fidelity (Wi-Fi) and BLUETOOTH® wireless technologies. Thus, the communication can be a predefined structure as with a conventional network or simply an ad hoc communication between at least two devices.

The computer is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi and Bluetooth™ wireless technologies. Thus, the communication can be a predefined structure as with a conventional network or simply an ad hoc communication between at least two devices.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11 (a, b, g, etc.) to provide secure, reliable, fast wireless connectivity. A Wi-Fi network can be used to connect computers to each other, to the Internet, and to wired networks (which use IEEE 802.3 or Ethernet). Wi-Fi networks operate in the unlicensed 2.4 and 5 GHz radio bands, at an 11 Mbps (802.11a) or 54 Mbps (802.11b) data rate, for example, or with products that contain both bands (dual band), so the networks can provide real-world performance similar to the basic 10BaseT wired Ethernet networks used in many offices.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the subject matter has been described herein in connection with various embodiments and corresponding FIGS., where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A method, comprising:

receiving audio data representing an audio signal from a microphone, by a server comprising a processor, wherein the audio data is representative of audio associated with an environment at a first time;

in response to the receiving the audio data, labeling, by the server, the audio data with the first time, resulting in labeled audio data;

at a second time later than the first time, receiving, by the server, request data representative of a request for the audio data received at the first time; and in response to the receiving the request data, sending, by the server, via a network, the labeled audio data for presentation during an augmented reality simulation of aspects of the environment associated with the first time, wherein the audio data comprises simulated audio representative of predicted audio to be associated with the environment.

2. The method of claim 1, wherein the environment is associated with a residence proximate to the microphone.

3. The method of claim 2, further comprising:

receiving, by the server, location data representative of a location of the microphone in relation to an augmented reality device, the augmented reality device being a device for presentation of the augmented reality simulation.

4. The method of claim 3, wherein the sending of the audio data is in response to a condition associated with the location being determined to have been satisfied.

5. The method of claim 1, wherein the audio comprises ambient noise associated with a neighborhood of a residence.

6. The method of claim 1, wherein the request data is first request data, wherein the request is a first request, and further comprising:

receiving, by the server, second request data representative of a second request for simulated audio data comprising the simulated audio representative of the predicted audio.

7. The method of claim 6, wherein the simulated audio is generated based on user input specifying a future time for which the predicted audio is to be predicted to occur within the environment.

8. A system, comprising:

a processor; and a memory that stores executable instructions that, when executed by the processor, facilitate performance of operations, comprising:

receiving audio data representative of audio associated with an environment at a first time;

in response to receiving the audio data, labeling the audio data, resulting in labeled audio data;

at a second time different from the first time, receiving request data representative of a request for the audio data at the first time; and in response to receiving the request data, sending the labeled audio data to an augmented reality device for output via the augmented reality device during a simulation of the environment associated with the first time, wherein the labeled audio data comprises simulated audio representative of predicted audio that is predicted to be associated with the environment.

9. The system of claim 8, wherein the labeling comprises labeling the audio data with time stamp data representative of a time stamp.

10. The system of claim 9, wherein the request data comprises an indication of the time stamp data.

11. The system of claim 10, wherein the indication is a duration of time that comprises the time stamp data.

12. The system of claim 8, wherein the labeling comprises labeling the audio data with location stamp data representative of a location of a microphone.

13. The system of claim 12, wherein the request data comprises an indication of the location stamp data.

14. The system of claim 13, wherein the indication is a location that comprises the location associated with the microphone.

15. A non-transitory machine-readable medium, comprising executable instructions that, when executed by a processor, facilitate performance of operations, comprising:

in response to receiving audio data representative of an audio associated with an environment, facilitating labeling the audio data; and in response to receiving request data representative of a request for the audio data, facilitating sending an audio file to an augmented reality device for render during a utilization of the augmented reality device, wherein an audio signal comprises the audio data, and wherein the audio file comprises simulated audio representative of a predicted audio to be associated with the environment.

16. A non-transitory machine-readable medium of claim 15, wherein the request data comprises a request for time stamp data.

17. A non-transitory machine-readable medium of claim 15, wherein the predicted audio is generated as a function of time.

18. A non-transitory machine-readable medium of claim 15, wherein the predicted audio is generated as a function of an increase in a type of vehicle predicted to be utilized in the environment.

19. A non-transitory machine-readable medium of claim 18, wherein the type of vehicle is an electric vehicle.

20. A non-transitory machine-readable medium of claim 15, wherein generation of the predicted audio results in a decibel value associated with the predicted audio being inversely proportional to an increase in the electric vehicles.

* * * * *